US005545064A

United States Patent [19]

Tsunekawa et al.

[11] Patent Number: 5,545,064

[45] Date of Patent: Aug. 13, 1996

[54] CONTROL FOR OUTBOARD MOTOR

[75] Inventors: Hiroyuki Tsunekawa; Kouji Abe, both of Hamamatsu, Japan

[73] Assignee: Sanshin Kogyo Kabushiki Kaisha, Hamamatsu, Japan

[21] Appl. No.: 304,097

[22] Filed: Sep. 9, 1994

[30] Foreign Application Priority Data

Sep. 9, 1993 [JP] Japan ..... 5-224664

[51] Int. Cl.[6] ..... B63H 5/12

[52] U.S. Cl. ..... 440/53; 440/86; 440/87

[58] Field of Search ..... 440/49, 53, 63, 440/84, 85, 86, 87

[56] References Cited

U.S. PATENT DOCUMENTS 3,503,360 3/1970 Hoff ..... 440/63
4,439,163 3/1984 Burmeister et al. ..... 440/84
4,582,493 4/1986 Toyohara et al. .
4,726,798 2/1988 Davis .
4,801,282 1/1989 Ogawa et al. .
5,122,084 6/1992 Lieb et al. .

*Primary Examiner*—Stephen P. Avila
*Attorney, Agent, or Firm*—Knobbe, Martens, Olson & Bear

[57] ABSTRACT

A throttle and transmission control assembly adapted to be mounted on the tiller of an outboard motor for controlling its transmission and throttle. Both the transmission and throttle controls employ devices that convert rotary into reciprocating motion and which amplify the reciprocating motion so as to permit a compact assembly. The movable components are all mounted on a single piece of the assembly so as to minimize manufacturing variations and to simplify the overall construction. In addition, an interlock is provided that controls the maximum speed at which the engine can be operated when in neutral and for blocking shifting into neutral from forward or reverse when operating at a greater than a predetermined speed but for permitting forced movement into neutral under some engine speeds and, at the same time, reducing the engine speed to the maximum permitted at neutral upon such shifting.

39 Claims, 11 Drawing Sheets

CONTROL FOR OUTBOARD MOTOR

BACKGROUND OF THE INVENTION

This invention relates to a control for an outboard motor and more particularly to an improved tiller mounted throttle and transmission control for such motor.

In order to facilitate the ease of operation of outboard motors, it has been proposed to attach to the end of the tiller a pivotally supported control handle that contains a controls for operating both the throttle and transmission of the outboard motor. Such attachments, be they accessories or installed originally on the outboard motor, offer considerable ease of operation. However, the type of devices presently utilized are susceptible of improvements in several areas.

For example, both the throttle and transmission control are connected to the appropriate portions of the outboard through bowden wire actuators. Conventionally, there is provided a twist grip throttle control and a pivotally supported shift control with the pivot axis of the shift control extending generally transverselly to the axis about which the throttle control rotates. It is desirable to maintain these controls relatively small and compact. However, it is difficult to obtain the desired degree of movement of the dog clutch of the transmission through conventional pivotally supported shift control levers. That is, the pivotal movement of the lever is relatively small and this small degree of pivotal movement must be transferred into a fairly large degree of reciprocal movement of the clutch for its engagement. This has necessitated rather large assemblies in order to achieve the requisite motion.

It is, therefore, a principal object of this invention to provide an improved outboard motor control that is compact in nature and yet which amplifies the degree of pivotal movement of the shift control lever into axial movement of the wire actuator for the transmission.

It is a further object of this invention to provide an improved transmission control for an outboard motor employing a compact motion amplifying mechanism.

In connection with the throttle and transmission control for outboard motors, it is also desirable to provide a mechanism that ensures that the operator does not attempt to shift from neutral into a forward or reverse drive condition with the engine operating at a high rate of speed. Attempting such transmission shifts when the engine is running at a high rate of speed not only places large loads on the clutch and gear mechanism of the transmission but can cause sudden movements of the watercraft that may be disconcerting to its occupants. However, when a control mechanism is designed to be mounted on the end of the tiller, it is difficult to obtain the necessary interlock arrangement in such a small space.

It is, therefore, a further object of this invention to provide an improved transmission and throttle control for an outboard motor wherein a simplified and compact interlock is provided between the transmission and throttle control.

It is a further object of this invention to provide an outboard motor transmission and throttle control mechanism wherein each mechanism has a motion amplifier and wherein a compact and simple interlock mechanism is provided.

In addition to providing protection against shifting into a forward or reverse mode from neutral with the engine operating at a high rate of speed, many of the interlocks previously proposed also limit the speed at which the engine may be operated in various transmission ratios. For example, the mechanisms may include an arrangement that limits the maximum speed of the engine or maximum throttle opening when operating in neutral. This prevents damage to the engine through running at a high speed with no load present. In addition, the interlocks frequently provide an arrangement that limits the speed of the watercraft when traveling in reverse.

This type of interlock mechanism between the transmission and the throttle, however, means that if the operator wishes to shift into a neutral condition when traveling at a high speed, the operator must first reduce the speed and then effect the shift. This is an unacceptable delay under some conditions.

It is, therefore, a still further object of this invention to provide an improved transmission and throttle control interlock mechanism for an outboard motor that will permit the operator to shift into neutral when the engine is operating at a speed higher than a predetermined speed and at the same time the shift is effected, the engine speed will be reduced.

In connection with the control and as has been previously noted, there is an advantage in providing a motion amplifier between the various controls and the bowden wires which they actuate. Frequently, the throttle control employs a bevel gear transmission for this operation. However, some outboard motors require rotation of the control in one direction to increase the throttle opening while others require rotation of the control in an opposite direction. In order to accommodate this with the previously proposed bevel gear transmissions, it is necessary to shift one of the bevel gears in the control to accomplish the different degree of rotation required for the particular outboard motor. This not only makes construction and assembly difficult but results in a transmission that does not always have smooth feel for the operator.

It is, therefore, a still further object of this invention to provide an improved bevel gear motion amplifier for the throttle control of an outboard motor that easily adapts itself to rotation in either direction for the appropriate outboard motor and also provides a smooth operating feel.

It should be readily apparent from the foregoing description that a desirable control mechanism of this type for an outboard motor incorporates a number of components that are interrelated with each other and which must be assembled in a small area. Also, these components should be installed within a neat appearing housing assembly and this gives rise to substantial problems, particularly when several housing pieces must be connected to each other and wherein the various elements of the control are contained within a cavity formed by the housing pieces.

It is, therefore, a still further object of this invention to provide an improved and simplified housing support arrangement for an outboard motor control.

It is a further object of this invention to provide an outboard motor transmission and throttle control that can be assembled in a manner wherein the spatial relationship between all of the components is easily controlled.

SUMMARY OF THE INVENTION

The several features of the invention are adapted to be embodied in an outboard motor control that is incorporated into a unit that is adapted to be affixed to the tiller of an outboard motor for controlling its transmission and throttle. The control comprises a housing assembly that is adapted to be affixed to the tiller and which incorporates a throttle control that is journaled by the housing assembly for rotation about a generally longitudinally extending first axis. A first motion translator is contained within the housing assembly for transmitting rotary motion of the throttle control into reciprocation of a throttle actuator element along a longitudinal axis and which throttle actuator element is adapted to be affixed to a first wire transmitter. A shift control is supported for pivotal movement by the housing assembly about a transversely extending second axis and a second motion translator translates pivotal movement of the shift control about the second axis into longitudinal movement of a shift actuator element that is adapted to be operatively connected to a second wire actuator.

In accordance with a first feature of the invention, the second motion transmitting means comprises a plurality of interconnected links.

In accordance with a second feature of the invention, motion amplifying means are incorporated into the second motion translator for amplifying the reciprocal movement of the shift control element along its second axis in response to a given pivotal movement of the shift control. In addition, interlock means are incorporated that preclude more than a predetermined degree of movement of the throttle actuating element when the shift control is in a first predetermined position.

In accordance with another feature of the invention, interlock means preclude movement of the throttle actuator element beyond a predetermined position when the shift actuator element is in a first predetermined position and for resisting movement of the shift actuating element from a second position to the first position when the throttle actuator element is in a second position. The interlock means include means that permit the movement of the shift control element from its second position to its first position when more than a predetermined force is applied to it and this movement effects movement of the throttle control element to the predetermined position upon such movement of the shift control element.

In accordance with another feature of the invention, the housing assembly includes at least two interconnected elements and the throttle control, shift control and first and second motion translating means are all supported by one of these first elements.

DETAILED DESCRIPTION OF THE PREFERRED EMBODIMENT OF THE INVENTION

Figure 1:
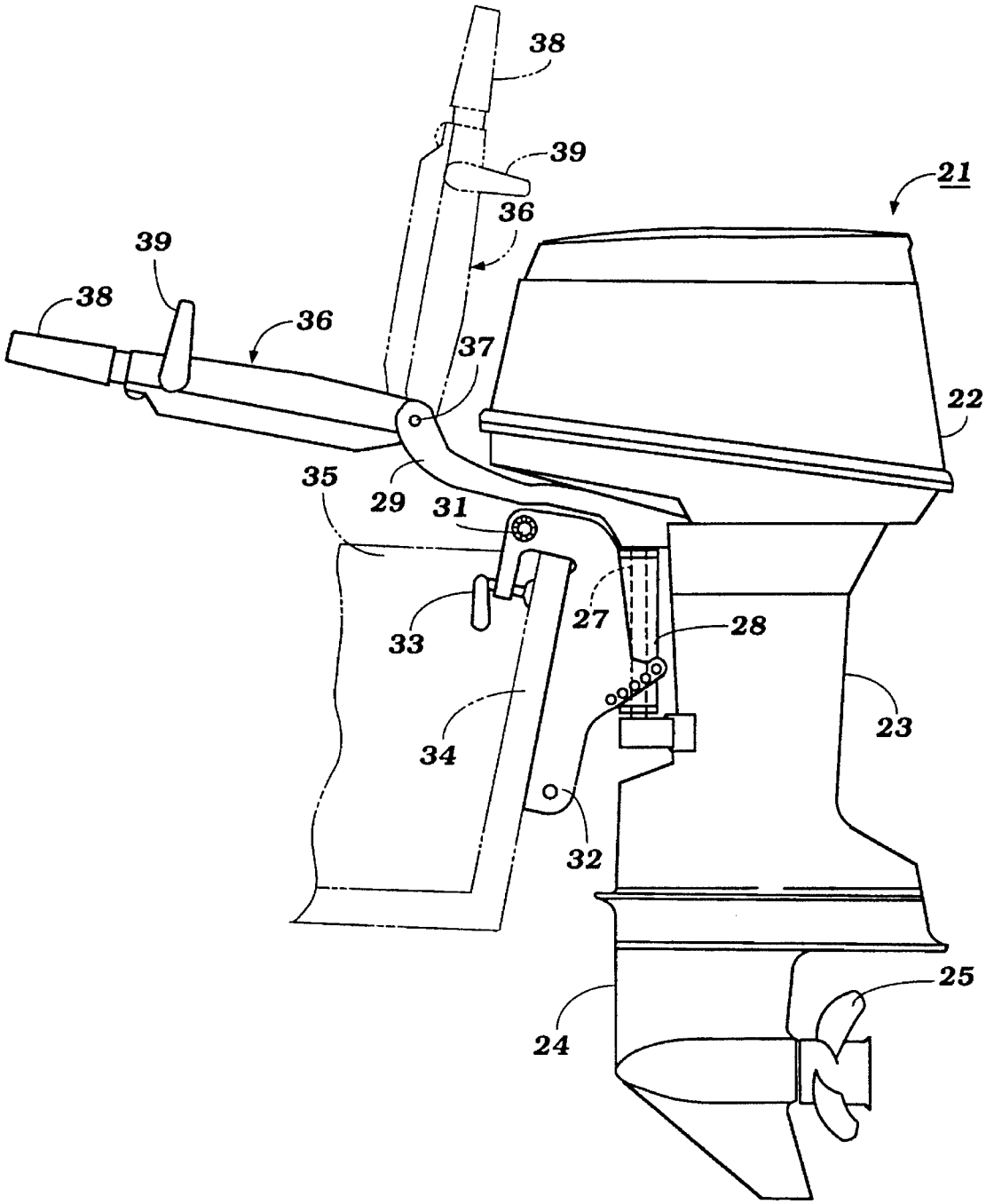
FIG. 1 is a side elevational view of an outboard motor constructed in accordance with an embodiment of the invention showing the control mechanism in its operative position in solid lines and in its storage position in phantom lines. The outboard motor is also shown as attached to the transom of a watercraft which is shown partially and in phantom.
Figure 2:
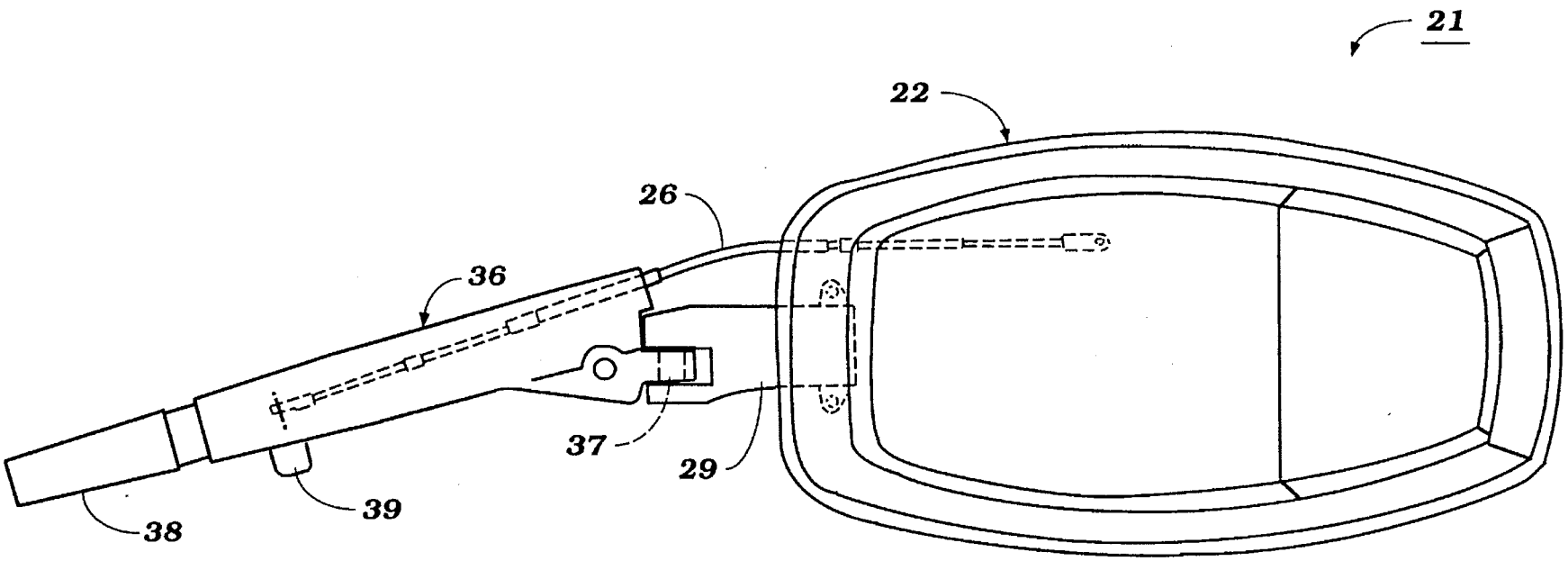
FIG. 2 is an enlarged top plan view of the outboard motor with the control handle in its operative position.

Referring now in detail to the drawing and initially to FIGS. 1 and 2, an outboard motors constructed and controlled in accordance with the embodiment of the invention is identified generally by the reference numeral 21. The outboard motor 21 is comprised of a power head, indicated generally by the reference numeral 22 which contains a powering internal combustion engine and a surrounding protective cowling. The engine is not depicted but it is to be understood that the invention can be used with any of a wide variety of types of engines. However, the invention deals with a manner for controlling the speed of the engine and this is normally done by controlling one or more throttle valves of the engine by means of a bowden wire cable. This bowden wire cable does not appear in FIGS. 1 and 2 but does appear in the later figures and will be described there.

As is typical with outboard motor practice, the engine of the power head 22 is supported so that its output shaft rotates about a vertically extending axis and this output shaft is connected to and drives a drive shaft (not shown) that depends through a drive shaft housing 23 positioned beneath the power head 22. The drive shaft housing 23 terminates in a lower unit 24 that contains a conventional forward neutral reverse transmission (not shown). The invention may be employed with any of a wide variety of such. transmissions and these transmissions frequently include a pair of counter-rotating bevel gears and a dog clutching for dog clutching these gears to a propeller shaft on which a propeller 25 is affixed for rotating the propeller 25 in forward or reverse position. When neither bevel gear is drivingly coupled to the propeller shaft, the propeller 25 is in neutral. Since the actual construction of the transmission is not critical to the invention, it has not been illustrated, but it is operated by means of a bowden wire cable, shown in FIG. 2 and identified generally by the reference numeral 26.

A steering shaft 27 is affixed to the drive shaft housing 23 and is journaled for steering movement within a swivel bracket 28. A tiller 29 is affixed to the upper end of the steering shaft 27 for steering of the outboard motor 21 in a manner well known in this art.

The swivel bracket 28 is, in turn, pivotally connected by means of a pivot pin 31 to a clamping bracket 32 for tilt and trim movement of the outboard motor 21 as is also well known in this art. The clamping bracket 32 carries a clamping device 33 or other means for attaching it to a transom 34 of an associated watercraft 35 which watercraft is shown partially and in phantom.

The construction of the outboard motor 21 as thus far described may be considered to be conventional and since the invention deals primarily with a control handle assembly, indicated generally by the reference numeral 36, further description of the outboard motor is not believed to be necessary. Where any portions of the outboard motor 21 have not been described, they may be considered to be conventional.

The control handle 36 is pivotally connected to the end of the tiller 29 by means of a pivot pin 37 so that the control handle 36 may be pivoted between its operative position as shown in solid lines in FIG. 1 and in FIG. 2 and a storage position as shown in phantom in FIG. 1. As will become apparent from the following description, the control handle 36 includes a twist grip throttle control 38 and a pivotally supported transmission control 39.

The control assembly 36 will now be described by primary reference to the remaining figures (FIGS. 3–18) and initially primarily by reference to FIGS. 3–9. The control assembly 36 includes a main housing assembly, indicated generally by the reference numeral 40 and which includes two interconnected outer housing parts, 41 and 42. These two parts are connected in a suitable manner and define an internal cavity 44 in which certain mechanisms, to be described, are contained. This includes an inner housing part 43 upon which all of the controls and the mechanisms which they operate are mounted.

The throttle control mechanism will first be described and as has been previously noted, this includes the twist grip throttle control 38 which the operator grasps not only to steer the outboard motor 21 but also to change the speed of the engine. This throttle control 38 is affixed to a throttle control shaft 45 that is journaled by the housing piece 43 on a first bearing portion 46 formed integrally with the housing piece 43 and a second bearing portion 47 that is affixed to the housing portion 43 adjacent its forward end and through which the throttle control shaft 45 extends for its connection to the throttle grip 38 in any known manner.

Figure 6:
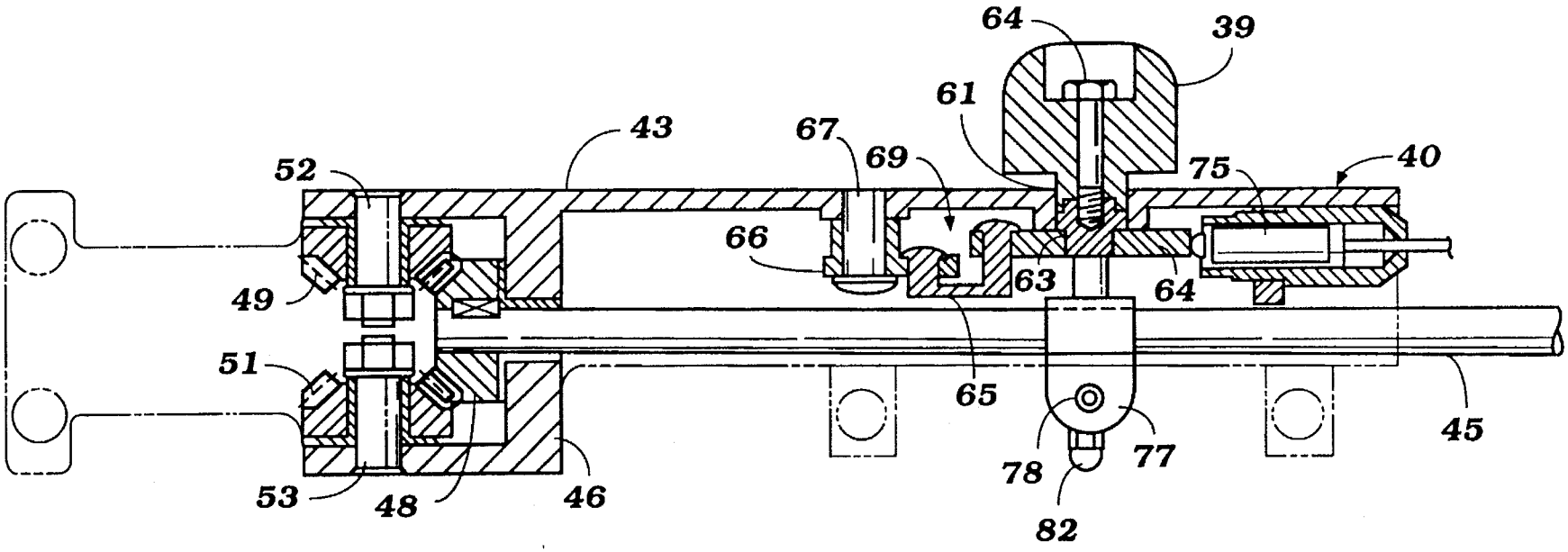
FIG. 6 is an enlarged view looking in the same direction as FIG. 4 and showing certain of the components in phantom.

As may be best seen in FIG. 6, the bearing 46 is formed by a generally channel-shaped member and inwardly of this member there is affixed for rotation with the throttle control shaft 45 a bevel gear 48. This bevel gear 48 is enmeshed with a pair of driven bevel gears 49 and 51 that are journaled on stub shafts 52 and 53, respectively. These stub shafts 52 and 53 are also affixed to the housing part 43 and specifically to its side legs. As should be readily apparent, rotation of the throttle control shaft 45 in one direction will cause rotation of the driven bevel gears 49 and 51 in opposite directions. By having the opposing bevel gears 49 and 51 in engagement with the gear 48, the loading on the gear 48 will be more uniform and as a result its rotation will be much smoother than if only a single bevel gear was employed.

Figure 3:
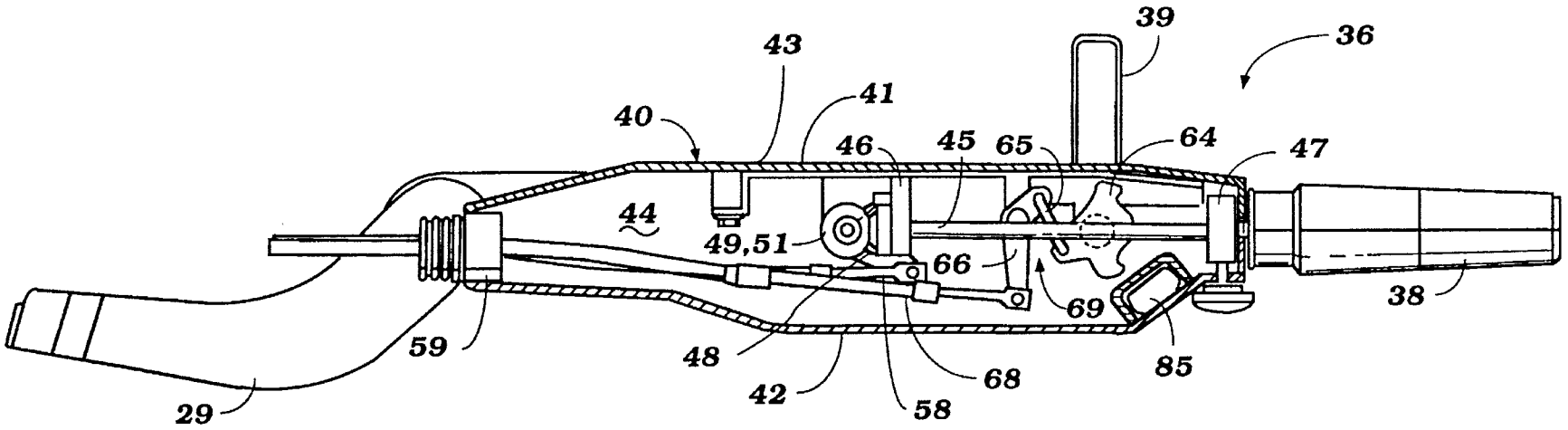
FIG. 3 is a side elevational view of the operating mechanism with a portion of the housing assembly broken away to more clearly show the construction.

In addition, since the gears 49 and 51 rotate in opposite directions, they may each be provided with a respective extending arm portion 54 and 55 (FIG. 9) which carries a respective fastener 56 and 57 it affords an adjustable connection to the throttle control bowden wire, indicated at 58 and shown only in FIG. 3. Hence, the single control 36 may be employed in conjunction with outboard motors having throttle control cables that operate in either direction of rotation without requiring any adjustment or modification of the interior component. All that need be done is to attach the bowden wire to the respective control arm portion 56 or 57. Thus, not only is smooth operation possible, but also the device lends itself to attachment to either type of outboard motor control without the user having to reassemble the parts at all.

Figure 4:
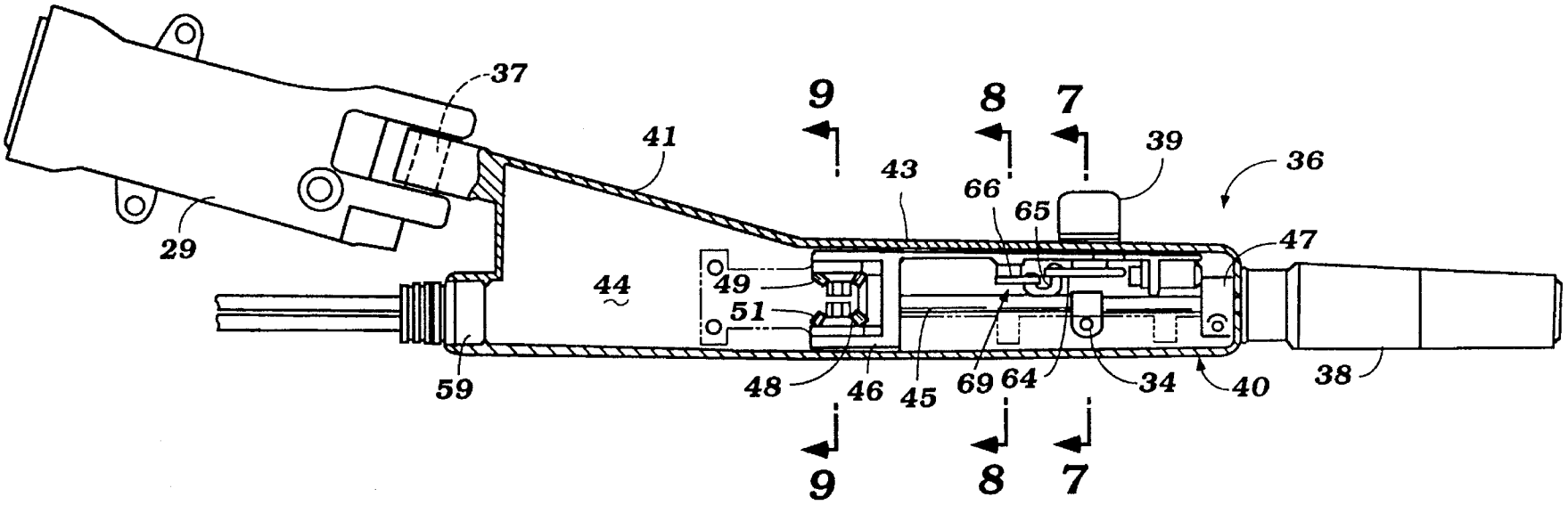
FIG. 4 is an enlarged top plan view of the control showing its attachment to the tiller and with a further portion of the housing assembly broken away to more clearly show the construction.

As may be seen in FIGS. 3 and 4, the bowden wire 58 as well as the transmission bowden wire to be described, pass through a grommet 59 that is captured between the housing parts 41 and 42 for their connection to the throttle and transmission of the outboard motor 21.

The transmission control will now be described by primary reference to FIGS. 3 through 8 and 10. As has been noted, the control lever 39 operates the transmission control and this control lever 39 has a cylindrical portion 61 formed at its hub with the square opening 62 but establishes a driving connection to a stub shaft 63 that is journaled in the housing piece 43. The transmission control lever 39 is fixed to the stub shaft 63 by means of a threaded fastener 64.

Figure 7:
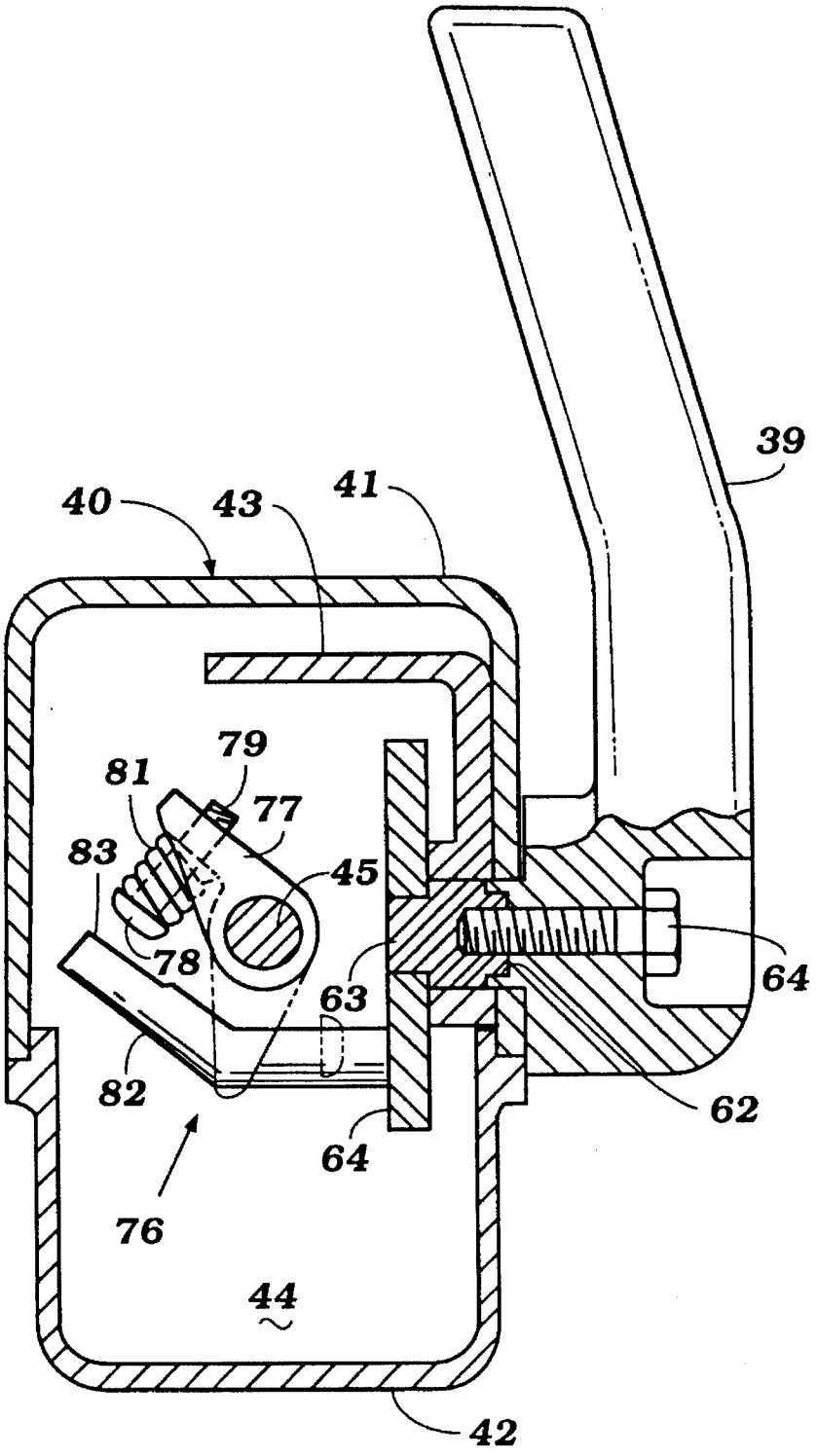
FIG. 7 is an enlarged cross-sectional view taken along the line 7—7 of FIG. 4.
Figure 8:
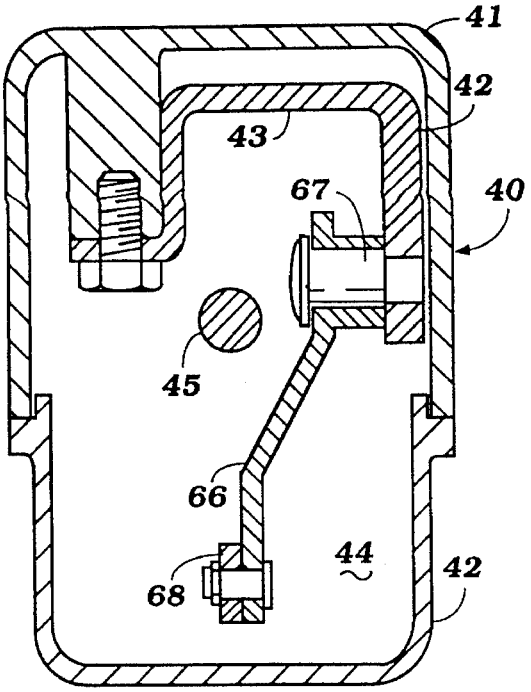
FIG. 8 is an enlarged cross-sectional view taken along the line 8—8 of FIG. 4.
Figure 9:
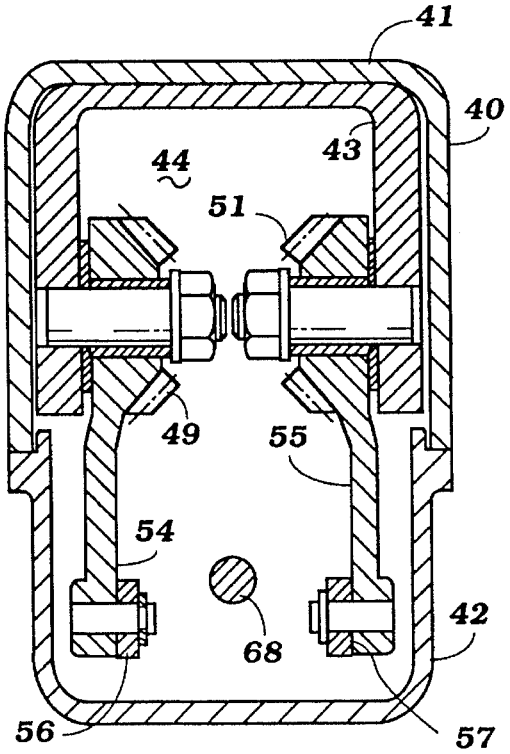
FIG. 9 is an enlarged cross-sectional view taken along the line 9—9 of FIG. 4.
Figure 10:
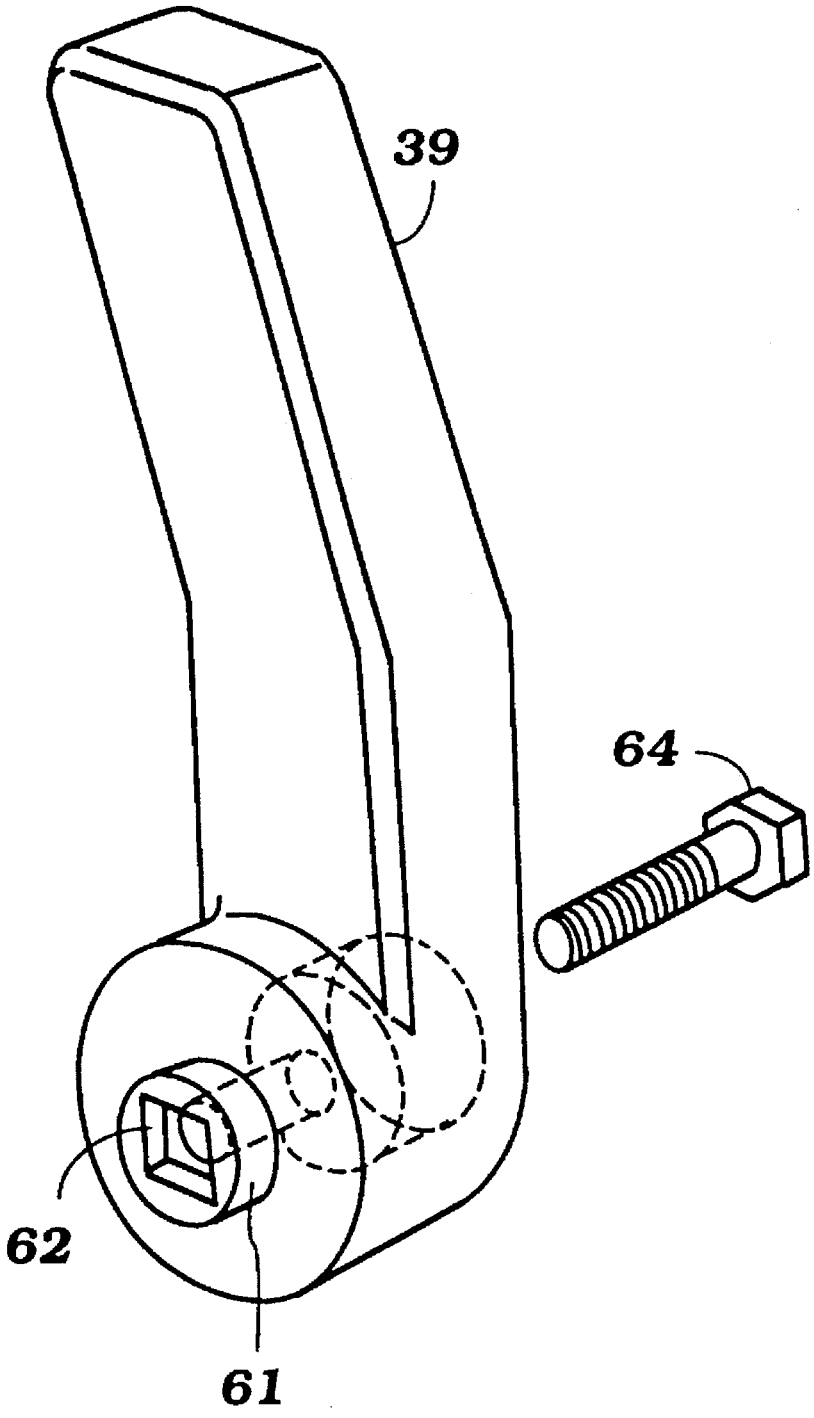
FIG. 10 is an exploded perspective view of the shift control lever and its method of attachment to the shift control shaft.
Figure 11:
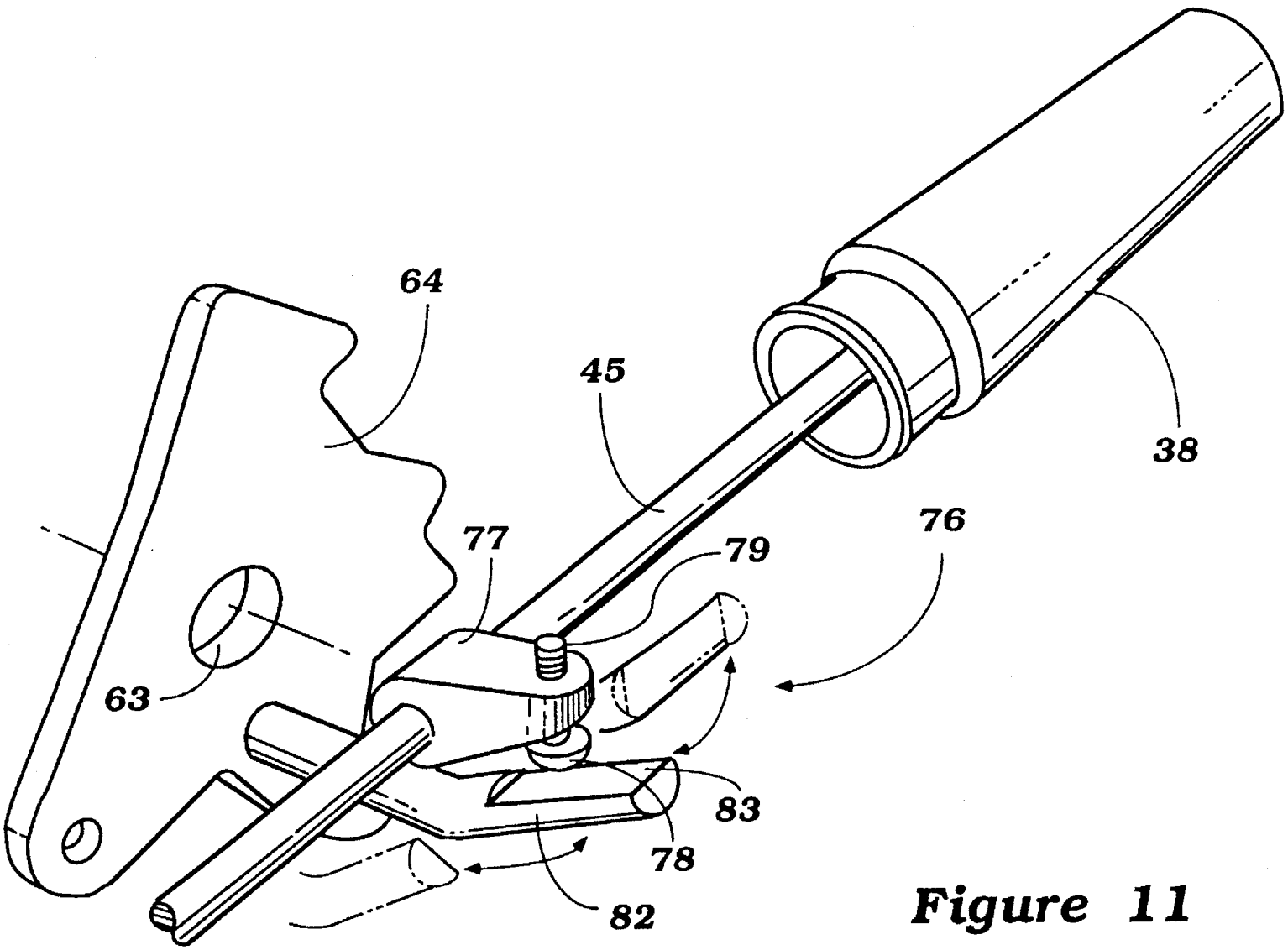
FIG. 11 is a perspective view showing the interlock between the throttle and the transmission controls.

It should be noted that the pivot axis defined by the stub shaft 63 extends transversely to the longitudinal axis of rotation of the throttle control shaft 45 and in fact these axes intersect and lie in a common plane as clearly seen in certain of the figures and particularly FIG. 7.

A first transmission control lever 64 is affixed to the inner end of the stub shaft 63. This first transmission control lever 64 has a lever arm to which one end of a transmission control link 65 is pivotally connected. The other end of the transmission control link 65 is pivotally connected to a second transmission control lever 66 which actually is formed as a bell crank. The link 65 is pivotally connected to one arm of this bell crank 66. The bell crank 66 is, in turn, pivotally connected on the housing piece 43 by a pivot pin 67. The pivot axis of the pivot pin 67 lies substantially on the same plane as the axis of rotation of the throttle control shaft 45 and also the axis of the stub shaft 63.

The link 66 has its other arm connected by a fastener to the transmission control bowden wire cable 68. Thus, the linkage system comprised of the transmission control levers 64 and 66 and link 65 form a motion amplifying mechanism, indicated generally by the reference numerals 69 which acts to magnify the degree of reciprocal motion of the transmission control wire actuator 68 in response to a given pivotal movement of the transmission control lever 39. As may be readily seen, this motion amplification is achieved in a very small area and thus the housing assembly 40 can be maintained quite compact while still achieving large degrees of motion for the controlling elements 58 and 54 for the throttle and transmission, respectively.

Figure 5:
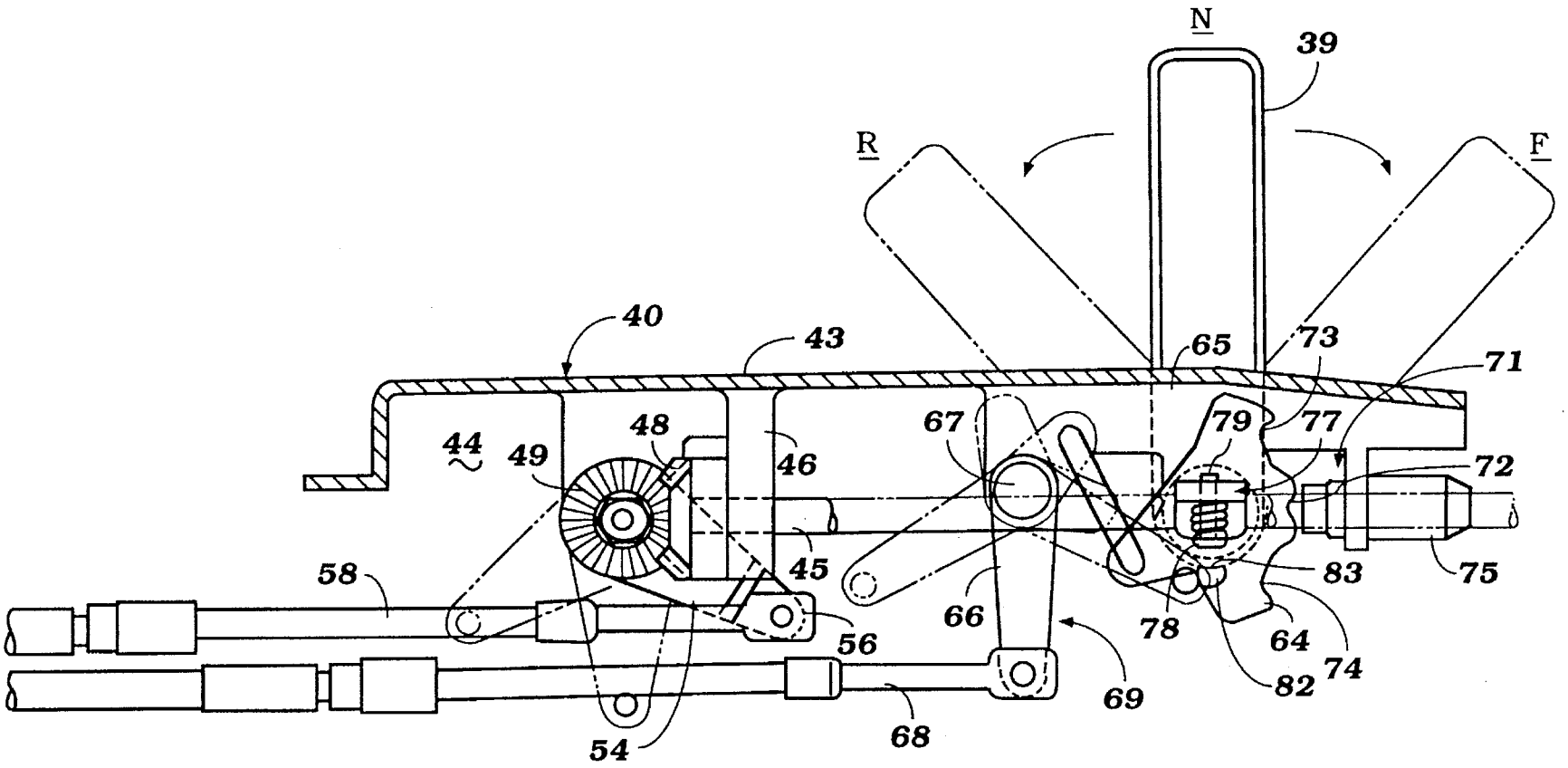
FIG. 5 is an enlarged cross-sectional view of the control and is taken in the same direction as FIG. 3 but shows the shift control mechanism and throttle control mechanisms in several positions in phantom line views in addition to a solid line view position.

A detent mechanism, indicated generally by the reference numeral 71 is provided for releasably retaining the transmission control lever 39 in its neutral forward and reverse positions as indicated by the letters N, F, R and shown in the solid and phantom line views of FIG. 5. To this end, the first transmission control lever 64 is provided with a neutral detent recess 72, a forward detent recess 73, and a reverse detent recess 74. A detent ball contained with a ball supporting assembly 75 is affixed to the housing piece 43 and is resiliently urged in a known manner into engagement with the recesses 72, 73, and 74 so as to releasably retain the transmission control lever 39 in each of its three positions. This also provides ease of operation for the operator.

The transmission and throttle control further includes an interlock mechanism, indicated generally by the reference numeral 76 and which is shown in most detail in FIGS. 5, 7, and 11–18 and will now be described-by primary reference to those figures. It should be understood, however, that certain components of the interlock mechanism 76 also appear in other of the figures.

Basically, the interlock mechanism 76 functions so as to preclude the running of the engine at greater than a predetermined speed when the transmission is in neutral, and for retarding the shifting of the transmission into neutral when the engine is running at greater than a predetermined speed. On the other hand and unlike the prior art, however, the transmission throttle interlock 76 does permit the operator to shift the transmission into neutral under an emergency condition by applying sufficient but a clear force and when this is done then the throttle control will be reduced to a speed no greater than the predetermined permissible speed at neutral.

The interlock mechanism includes a stop lever 77 that is fixed for rotation with the throttle control shaft 45 and which carries a semi-spherical headed adjustable stop screw 78 that has a threaded end 79 threadably received in the stop lever 77 and which is held in its adjusted position by means of a coil spring 81 that is interposed between the head of the screw 78 and the stop lever 77.

A stop cam in the form of a generally dog leg shaped rod 82 is affixed to the shift lever 64 in a position so as to be aligned axially with the head of the stop screw 78 when the shift lever 39 is in its neutral position. This member 82 is provided with a flattened surface 83 which will be contacted by the head of the screw 78 when an attempt is made to open the throttle by rotating the throttle control shaft 45 more than a predetermined amount when the transmission is shifted into neutral. The actual speed at which the engine is limited is determined by the position of the stop screw 78 relative to the lever 77, as should be readily apparent.

As also should be readily apparent, when the shift lever 39 is moved to shift the transmission into either forward or neutral, the stop rod 82 will be positioned clear of the stop screw 78 and hence the speed of the engine can be increased as desired. Also, once the speed is increased more than the maximum speed permitted at idle then the stop screw 78 will tend to resist shifting of the transmission back into neutral. However, in accordance with a feature of the invention, if the speed of the engine is not more than a predetermined speed which is higher than the maximum permitted idle speed, then the transmission can be shifted back into neutral and the engine speed will be reduced automatically to the predetermined maximum idle speed in neutral. The way this is done may be best understood by reference to FIGS. 12–18.

Figure 12:
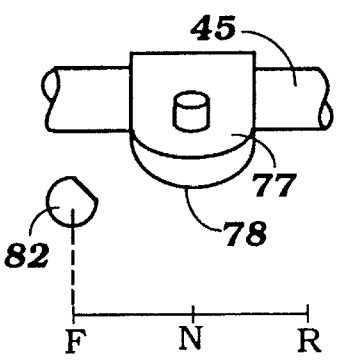
FIGS. 12–18 are a series of figures showing how the transmission throttle control interlock operates when shifting from a forward speed condition (FIG. 12) to neutral (FIG. 18) and when the throttle has been opened beyond the point where the throttle can be opened in neutral and showing how the engine speed is reduced upon shifting into neutral.
Figure 13:
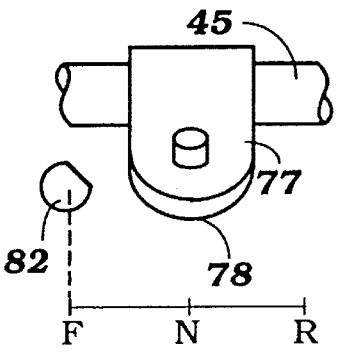
Figure 14:
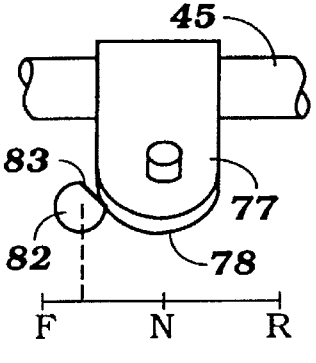

FIG. 12 shows the initial condition when the transmission has been shifted into a forward drive mode and the throttle shaft 45 has been positioned at a speed which is at or below the maximum permitted idle speed. Thereafter, the throttle may be opened further by rotation of the throttle lever 45 as shown in FIG. 13. If the throttle lever is rotated sufficiently so that the head of the adjusting screw 78 is past the point where the rod 82 sweeps, then the transmission cannot be shifted back into neutral under any circumstances. If, however, the throttle is closed to an extent that is greater than the maximum permitted speed in neutral but still less than a wide open throttle as shown in FIG. 14, then a shift to neutral will be possible.

Figure 15:
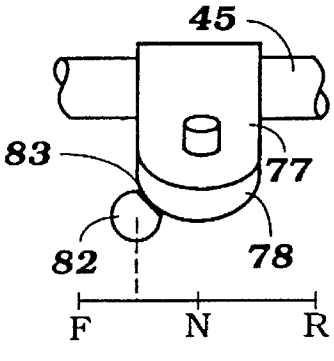
Figure 16:
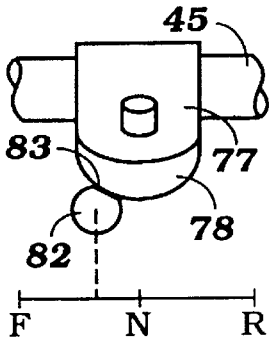
Figure 17:
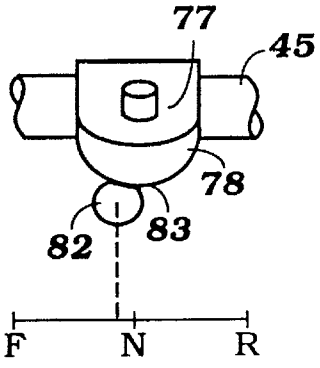
Figure 18:
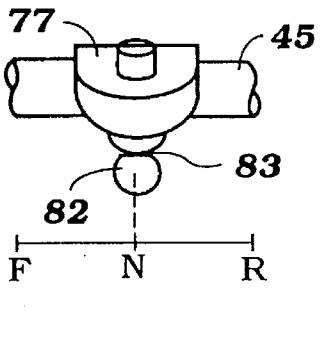

As the operator moves the shift lever 39 from the forward position toward the neutral position, the flat portion 83 will contact the head of the screw 78 and the operator will feel a resistance to further motion. However, in an emergency situation by providing sufficient force to the shift lever then the shift lever 39 will continue to move as shown in FIGS. 15–17 toward the neutral position. Because of the round head of the stop screw 78, the flat surface 83 will cam the top screw 78 and stop lever 77 in a direction so as to close the throttle valve by rotating the throttle valve shaft 45 in the closing direction. When this occurs, the engine speed will obviously be reduced and this will continue until the transmission is shifted fully into neutral as shown in FIG. 18 at which time the engine speed will be reduced to that maximum speed permitted at neutral. Obviously, the same action can be achieved when shifting from reverse to neutral.

In addition to the transmission and throttle controls 39 and 38, other controls may be carried by the assembly 36. As an example, a PT/T control switch, indicated generally by the reference numeral 85, may be carried by the housing assembly on its underside and coupled to a hydraulic tilt-and-trim arrangement for the outboard motor for permitting tilt-and-trim adjustment. Other controls such as a kill switch may also be carried by the housing assembly 36.

It should be apparent from the foregoing description that the described mechanism provides a really compact and yet highly effective transmission and throttle control for an outboard motor wherein motion amplification between the throttle controlling and transmission controlling elements is achieved while a compact structure is provided and also this structure permits smooth operation and does not require complicated assembly because all moving components are supported on the common element of the housing. In addition, the transmission throttle control interlock permits limiting of the speed of the engine in neutral and also retards shifting of the transmission into neutral when the engine is more than a predetermined speed. However, at lower speed, shifting into neutral is possible even if the speed is greater than that permitted at neutral but the engine speed will be reduced to that maximum permitted at neutral when the transmission is forced into neutral under these conditions. Of course, the foregoing description is that of a preferred embodiment of the invention and various changes and modifications may be made without departing from the spirit and scope of the invention, as defined by the appended claims.

We claim:

1. An outboard motor control incorporated into a unit adapted to be affixed to a longitudinally extending tiller of an outboard motor for controlling the transmission and throttle of the outboard motor, said control comprising a housing assembly adapted to be affixed to the tiller in aligned relation therewith, an operator actuated throttle control journaled by said housing assembly for rotation about a generally longitudinally extending first axis, a first motion translator for translating rotary motion of said throttle control into reciprocation of a throttle actuating element contained within said housing assembly along a longitudinal axis, an operator actuated shift control independent of said throttle control and supported for pivotal movement by said housing assembly about a transversely extending second axis, and a second motion translator comprised of a plurality of interconnected links for transmitting pivotal movement of said shift control about said second axis into longitudinal movement of a shift actuator element within said housing assembly.

2. An outboard motor control as in claim 1, wherein the links of the second motion translator amplifies the degree of longitudinal movement of the shift actuator element in response to a given degree of pivotal movement of the shift control.

3. An outboard motor control as in claim 2, wherein the throttle actuator element and the shift actuator element are each connected to a respective wire actuator for actuating the throttle and transmission, respectively.

4. An outboard motor control as in claim 3, wherein the connection of the actuator element to the respective wire actuator permits adjustment of the wire actuator relative to the actuator element.

5. An outboard motor control as in claim 2, wherein the linkage system includes a pair of interconnected levers, each providing a respective motion amplification.

6. An outboard motor control as in claim 5, wherein the levers are interconnected by means of a link.

7. An outboard motor control as in claim 6, further including detent means formed on one of the levers for restraining the shift control in at least one position corresponding to a specific drive condition of the transmission.

8. An outboard motor control as in claim 2, wherein the housing assembly includes at least one housing element that supports the throttle control, the first motion translator, the throttle actuating element, the shift control, the second motion translator, and the shift actuator element.

9. An outboard motor control as in claim 8, wherein the first and second axes both lie in substantially the same plane.

10. An outboard motor control as in claim 9, wherein the links of the linkage system are pivotally supported about axes that lie substantially in the same plane as the first and second axes.

11. An outboard motor control as in claim 10, wherein the first motion translator amplifies the motion of the throttle actuator element for a given degree of rotation of the throttle control.

12. An outboard motor control as in claim 11, wherein the first motion translator includes a pair of inter-engaging bevel gears.

13. An outboard motor control as in claim 12, wherein a first bevel gear is affixed for rotation with the throttle control and is engaged on diametrically opposite sides by respective second and third bevel gears, either of which can be operably connected to the throttle actuator element.

14. An outboard motor control as in claim 13, wherein the axis of rotation of the driven bevel gears also lies in the same plane as the first and second axes.

15. An outboard motor control as in claim 1, further including interlock means operably connected between the first and second motion translators for limiting their relative positions.

16. An outboard motor control as in claim 15, wherein the interlock means precludes the rotation of the throttle control more than a predetermined amount when the shift control is in a position corresponding to a specific condition of the transmission actuated by it.

17. An outboard motor control as in claim 16, wherein the interlock means further precludes shifting of the transmission control lever into the first position when the throttle control is open more than a predetermined amount.

18. An outboard motor control as in claim 17, wherein the interlock means is constructed so that the shift control can be moved into the one transmission condition if sufficient force is applied to the shift control and wherein the position of the throttle control is also moved to its limited position when the shift control is so moved.

19. An outboard motor control as in claim 18, wherein the shift control can only be forced to its predetermined position if the throttle control is in a predetermined position indicative of a greater throttle opening than the maximum throttle opening permitted but less than full throttle when the movement of the throttle control is limited by the interlock means.

20. An outboard motor control incorporated into a unit adapted to be affixed to a tiller of an outboard motor for controlling its transmission and throttle, said control comprising a housing assembly adapted to be affixed to the tiller, an operator activated throttle control journaled by said housing assembly for rotation about a generally longitudinally extending first axis, a first motion translator for translating rotary motion of said throttle control into reciprocation of a throttle actuating element along a longitudinal axis, an operator actuated shift control supported for pivotal movement by said housing assembly independently of said throttle control about a transversely extending second axis, a second motion translator comprised of motion amplifying means for translating pivotal movement of said shift control about said second axis into longitudinal movement of a shift actuator element and at an accelerated amount, and interlock means for precluding more than a predetermined degree of movement of said throttle actuating element when said shift control element is in a first predetermined position.

21. An outboard motor control as in claim 20, wherein the transmission is movable between a forward drive position and a neutral position and wherein the first predetermined position of the shift control corresponds to the neutral position of the transmission.

22. An outboard motor control as in claim 21, wherein the transmission further includes a reverse drive mode.

23. An outboard motor control as in claim 20, wherein the interlock means further precludes means for restricting the shifting of the shift control from either the forward drive position or the reverse drive position to the neutral position when the throttle control is opened more than the predetermined amount.

24. An outboard motor control as in claim 23, wherein the interlock means is constructed so as to permit forced movement of the shift control into its neutral position and doing so effects movement of the throttle control to the maximum speed position permitted when in the neutral position.

25. An outboard motor control as in claim 23, wherein the forced movement of the shift, control is permissible only if the throttle control is in a position corresponding a speed that exceeds the maximum permitted neutral speed by a certain amount.

26. An outboard motor control as in claim 25, wherein the interlock includes a cam and follower arrangement which permits forced movement during a portion of its travel and which precludes movement during another portion of its travel.

27. An outboard motor control as in claim 26, wherein the interlock means comprises a lever affixed to the throttle control and a cam member affixed to the shift control and wherein the lever carries an adjustable follower engaged with the shift control cam member.

28. An outboard motor control as in claim 22, wherein the motion amplifying means comprises a first lever affixed for rotation with the shift control, a second lever connected at one end thereof to the shift actuator element and supported for pivotal movement about a pivot axis, and a link pivotally connecting said lever.

29. An outboard motor control as in claim 20, wherein the motion amplifying means comprises a first lever affixed for rotation with the shift control, a second lever connected at one end thereof to the shift actuator element and supported for pivotal movement about a pivot axis, and a link pivotally connecting said lever.

30. An outboard motor control as in claim 29, wherein the first motion translating means also effects an amplification of the amount of movement of the throttle actuating element relative to the rotary movement of the throttle control.

31. An outboard motor control as in claim 30, wherein the housing assembly includes at least one housing element that supports the throttle control, the first motion translator, the throttle actuating element, the shift control, the second motion translator, and the shift actuator element.

32. An outboard motor control incorporated in a unit adapted to be affixed to a tiller of an outboard motor for controlling the transmission and throttle of the outboard motor, said control comprising a housing assembly adapted to be affixed to the tiller, a throttle control journaled by said housing assembly for rotation about a generally longitudinally extending first axis, a first motion translator for translating rotary motion of said throttle control into reciprocation of a throttle actuating element along a longitudinal axis, a shift control supported for pivotal movement by said housing assembly about a transversely extending second axis, a second motion translator for translating pivotal movement of said shift control element about said axis into longitudinal movement of a shift actuator element, and interlock means for precluding movement of said throttle actuating element beyond a predetermined position when said shift actuating element is in a first predetermined position and for resisting movement of said shift actuator element from a second position to said first position when said throttle actuator element is in a second position, said interlock means being effective to permit movement of said shift actuator element from said second position to said first position upon the exertion of more than a predetermined force and for moving said throttle actuator element to its predetermined position upon movement of said shift actuator element from its second position to its first position.

33. An outboard motor control as in claim 32, wherein the transmission is movable between a forward drive position and a neutral position and wherein the first predetermined position of the shift control corresponds to the neutral position of the transmission.

34. An outboard motor control as in claim 33, wherein the transmission further includes a reverse drive mode.

35. An outboard motor control as in claim 32, wherein the interlock includes a cam and follower arrangement which permits forced movement during a portion of its travel and which precludes movement during another portion of its travel.

36. An outboard motor control as in claim 35, wherein the interlock means comprises a lever affixed to the throttle control and a cam member affixed to the shift control and wherein the lever carries an adjustable follower engaged with the shift control cam member.

37. An outboard motor control as in claim 36, wherein the second motion translator comprises a first lever affixed for rotation with the shift control and carrying the cam member, a second lever connected at one end thereof to the shift actuator element and supported for pivotal movement about a pivot axis, and a link pivotally connecting said lever.

38. An outboard motor control incorporated into a unit adapted to be affixed to a tiller of an outboard motor for controlling of the transmission and throttle of said outboard motor, said control comprising a housing assembly comprised of at least two interconnected elements adapted to be affixed to the tiller, a throttle control journaled by a first element of said housing assembly for rotation about a generally longitudinally extending first axis, a first motion translator supported by said first element of said housing assembly for translating rotary motion of said throttle control into reciprocation of a throttle actuator element along a longitudinal axis, a shift control supported for pivotal movement by said first element of said housing assembly about a transversely extending second axis, and second motion transmitting means supported by said first element of said housing assembly for transmitting pivotal movement of said shift control about said second axis into longitudinal movement of a shift actuator element.

39. An outboard motor control as in claim 38, wherein the first and second axes lie substantially on a common plane.

* * * * *